US006283200B1

(12) United States Patent
Sugimoto et al.

(10) Patent No.: US 6,283,200 B1
(45) Date of Patent: Sep. 4, 2001

(54) HEAT EXCHANGER HAVING HEADER TANK INCREASED IN VOLUME IN THE VICINITY OF PIPE CONNECTED THERETO

(75) Inventors: Tatsuo Sugimoto, Okazaki; Norihisa Sasano, Ama-gun; Satomi Muto, Nishikasugai-gun; Takaaki Sakane, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/449,916

(22) Filed: Dec. 2, 1999

(30) Foreign Application Priority Data

Dec. 3, 1998 (JP) ..... 10-344472
Oct. 7, 1999 (JP) ..... 11-287207

(51) Int. Cl.[7] ..... F28F 9/02
(52) U.S. Cl. ..... 165/173; 165/174
(58) Field of Search ..... 165/173, 151, 165/153, 148, 176, 175

(56) References Cited

U.S. PATENT DOCUMENTS 1,109,384 * 9/1914 Alexander ..... 165/173
1,782,058 * 11/1930 Campbell ..... 165/148
2,264,820 * 12/1941 Young ..... 165/173
3,455,377 * 7/1969 Hayes ..... 165/148
4,709,757 * 12/1987 Bly ..... 165/173
4,940,086 * 7/1990 Stay ..... 165/173
5,009,262 * 4/1991 Halstead et al. ..... 165/173
5,252,778 * 10/1993 Ogawa ..... 165/175
5,351,751 * 10/1994 Cage et al. ..... 165/173
6,116,335 * 9/2000 Beamer et al. ..... 165/174

* cited by examiner

*Primary Examiner*—Ira S. Lazarus
*Assistant Examiner*—Terrell McKinnon
(74) *Attorney, Agent, or Firm*—Harness, Dickey & Pierce, PLC

(57) ABSTRACT

A heat exchanger has plural tubes and a header tank communicating with each tube. The tank has an opening through which coolant is introduced, and an elevated portion formed in the vicinity of the opening by elevating a wall of the tank outwardly, so that a dimension of the tank including the elevated portion becomes larger than a dimension of the tank excluding the elevated portion in a direction perpendicular to a longitudinal direction of the tank. As a result, a volume and a sectional area of the tank in the vicinity of the opening are increased, thereby decreasing pressure loss of coolant flowing into the tank. Therefore, even when a size of the tank is reduced to reduce a size of the heat exchanger, pressure loss of coolant flowing into the tank is restricted from increasing.

19 Claims, 5 Drawing Sheets

HEAT EXCHANGER HAVING HEADER TANK INCREASED IN VOLUME IN THE VICINITY OF PIPE CONNECTED THERETO

CROSS REFERENCE TO RELATED APPLICATIONS

This application relates to and claims priority from Japanese Patent Application Nos. 10-344472 filed on Dec. 3, 1998 and 11-287207 filed on Oct. 7, 1999, the contents of which are hereby incorporated by reference.

BACKGROUND OF THE INVENTION

1. Field of the Invention

The present invention relates to a heat exchanger, and is suitably applied to a radiator which cools engine coolant of a vehicle engine.

2. Related Art

Conventionally, a radiator has plural tubes, a first header tank connected to one flow-path end of each tube and a second header tank connected to the other flow-path end of each tube. Coolant introduced into the first header tank is distributed into each tube and is heat-exchanged with air while flowing through each tube. After heat exchange, coolant is discharged from each tube and is collected into the second header tank.

Recently, while the number of devices disposed in an engine compartment of a vehicle has been increased, size reduction of each device such as a radiator has been demanded to enlarge a passenger compartment of the vehicle without increasing a vehicle body size. It is proposed to reduce a volume of the header tank to reduce a size of the radiator.

However, the header tank has an opening through which coolant flows into the header tank, and the opening is open in a direction perpendicular to a longitudinal direction of the header tank, for example. Therefore, when coolant flows into the header tank, coolant changes a flow direction by approximately 90 degrees at the opening. Further, a sectional area of the header tank is relatively small due to volume reduction of the header tank in comparison with an area of the opening, a sectional area of a coolant flow passage of the radiator is largely decreased in the header tank. As a result, coolant may largely lose pressure thereof in the header tank, and flow resistance of coolant in the header tank may be increased.

SUMMARY OF THE INVENTION

In view of the foregoing problems, it is an object of the present invention to provide a heat exchanger having a header tank reduced in size and decreasing pressure loss of fluid in the header tank.

According to the present invention, a heat exchanger has plural tubes through which fluid flows and a tank communicating with each tube. The tank has an opening open in a direction at a preset angle to a longitudinal direction of the tank, and an elevated portion elevated outwardly in the vicinity of the opening. A dimension of the tank including the elevated portion in a direction perpendicular to the longitudinal direction of the tank is larger than a dimension of the tank excluding the elevated portion in the direction perpendicular to the longitudinal direction of the tank.

As a result, a volume of the tank and a sectional area of the tank in the vicinity of the opening are increased. Therefore, when fluid enters the tank while changing a flow direction through the opening, pressure loss of fluid is decreased. Further, since the sectional area of the tank in the vicinity of the opening is increased, a sectional area of a fluid flow passage of the heat exchanger is restricted from being largely decreased in the tank. As a result, pressure loss of fluid in the tank is further decreased. Thus, a size of the tank is reduced while pressure loss of fluid in the tank is decreased.

Preferably, an inner diameter of an inserted portion of a pipe inserted into the opening is increased toward an inside of the tank. As a result, fluid flows smoothly at a connection portion between the pipe and the tank, and pressure loss of fluid in the tank is further decreased.

More preferably, the opening is formed in the elevated portion. As a result, a width of the heat exchanger including the pipe in an air flow direction is maintained even when a width of the tank in the air flow direction is increased by the elevated portion.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

(First Embodiment)

Figure 1:
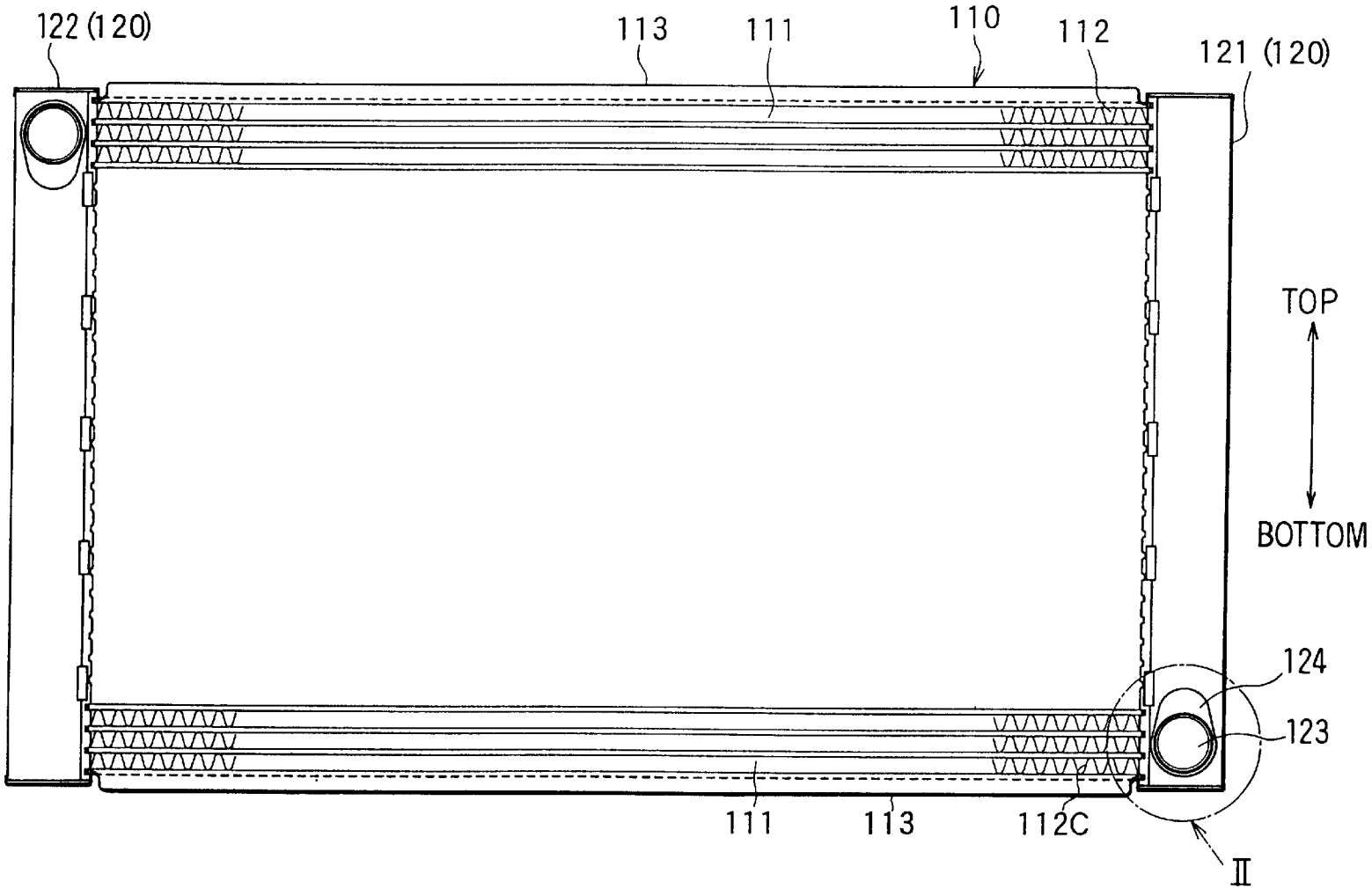
FIG. 1 is a front view showing a radiator according to a first preferred embodiment of the present invention.

A first preferred embodiment of the present invention will be described with reference to FIGS. 1–6B. In the first embodiment, the present invention is applied to a radiator for cooling engine coolant of a vehicle engine. In FIG. 1, a radiator 100 is viewed from a downstream air side with respect to air passing through the radiator 100, that is, from a rear side of the same.

As shown in FIG. 1, the radiator 100 has plural aluminum tubes 111 through which engine coolant flows, and plural aluminum corrugated fins 112 disposed between adjacent tubes 111 to facilitate heat exchange between air and engine coolant. The tubes 111 and the fins 112 form a heat exchange core portion 110 which cools engine coolant through heat exchange between engine coolant and air. Each fin 112 is clad with brazing material on both side surfaces thereof, and is brazed to the tubes 111 using the brazing material. Plates 113 are attached to the core portion 110 to reinforce strength of the core portion 110.

A first header tank 121 is disposed at one flow-path end of each tube 111, that is, a right end of each tube 111 in FIG. 1. The first header tank 121 extends in a direction perpendicular to a longitudinal direction of each tube 111, and communicates with each tube 111. Engine coolant from the engine flows into the first header tank 121 and is distributed to each tube 111. A second header tank 122 is disposed at the other flow-path end of each tube 111. The second header tank 122 also extends in the direction perpendicular to the longitudinal direction of each tube 111, and communicates with each tube 111. After engine coolant is heat-exchanged with air, engine coolant is discharged from each tube 111, and is collected into the second header tank 122. Hereinafter, the first and second header tanks 121, 122 are collectively referred to as a tank 120.

Figure 3:
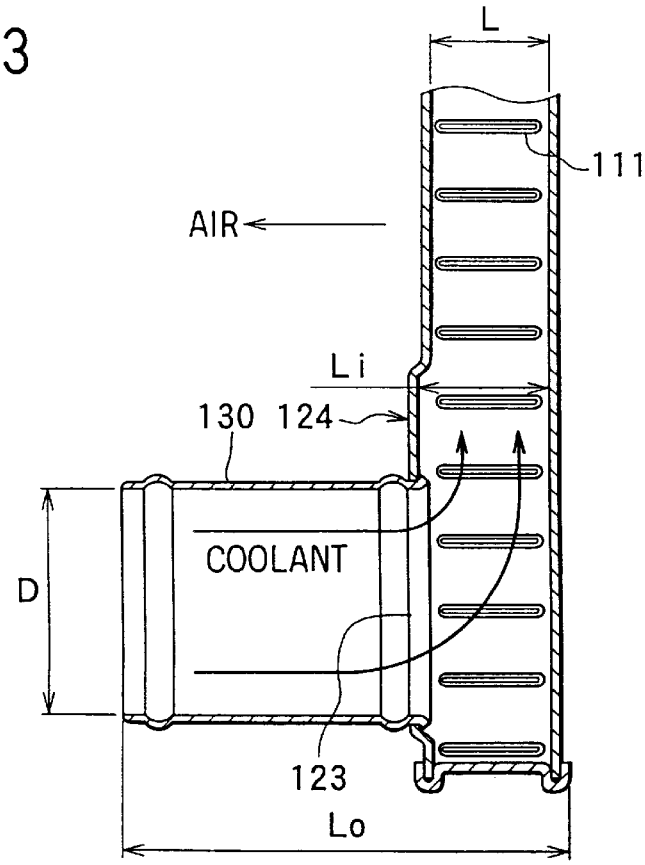
FIG. 3 is a sectional view taken along line III—III in FIG. 2.
Figure 4:
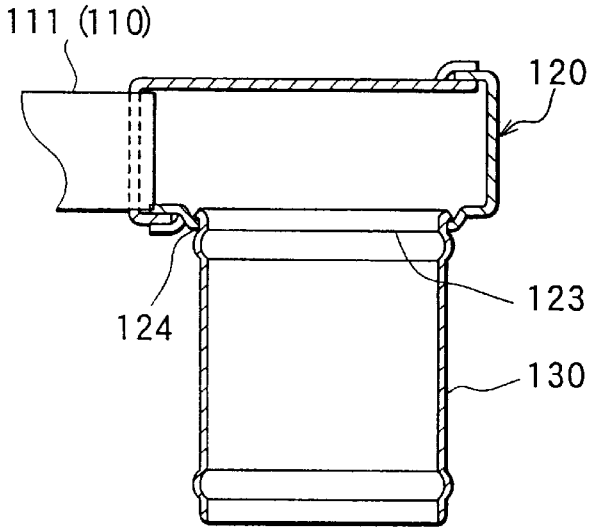
FIG. 4 is a sectional view taken along line IV—IV in FIG. 2.

As shown in FIG. 1, the tank 120 has an opening 123 at a lower end of the tank 120 in a longitudinal direction thereof. As shown in FIG. 3, the opening 123 is open in a direction perpendicular to the longitudinal direction of the tank 120. A cylindrical connection pipe 130 is inserted into the opening 123 and is connected to the tank 120. The pipe 130 is also connected to an external pipe (not shown) which is connected to the engine. Further, as shown in FIGS. 3 and 4, an inner diameter of an inserted portion of the pipe 130 is increased toward an inside of the tank 120. The tank 120 and the pipe 130 are made of aluminum, and are integrally brazed to each other by brazing.

Figure 2:
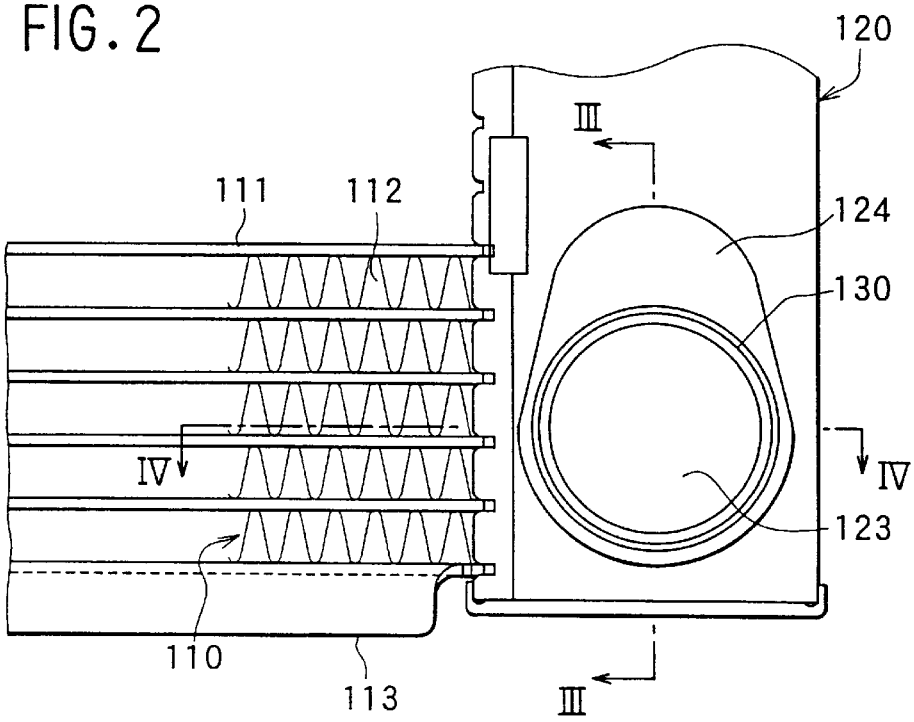
FIG. 2 is an enlarged view showing a portion indicated by arrow II in FIG. 1.

Further, as shown in FIGS. 2–4, the tank 120 has an elevated portion 124 formed by elevating a wall of the tank 120 outwardly in the vicinity of the opening 123. As shown in FIG. 3, the tank 120 has a dimension Li in a direction perpendicular to the longitudinal direction of the tank 120 (i.e., in an air flow direction) where the elevated portion 124 is formed. On the other hand, the tank 120 has a dimension L in the direction perpendicular to the longitudinal direction of the tank 120 where the elevated portion 124 is not formed. The dimension Li is larger than the dimension L. Further, as shown in FIG. 2, the opening 123 is disposed in a lower portion of the elevated portion 124 to be adjacent to the lower end of the tank 120. Referring back to FIG. 1, the tank 120 also has an elevated portion in the vicinity of an opening through which coolant is discharged. The opening is disposed at an upper end of the tank 120 in the longitudinal direction thereof in FIG. 1.

Referring to FIG. 3, the number of the tubes 111 connected to a portion of the tank 120 between a center of the elevated portion 124 in the longitudinal direction of the tank 120 and the lower end of the tank 120 (hereinafter referred to as the lower tank portion) is smaller than the number of the tubes 111 connected to a portion of the tank 120 between the center of the elevated portion 124 and an upper end of the tank 120 in the longitudinal direction of the tank 120 (hereinafter referred to as the upper tank portion). As a result, when coolant flows into the tank 120, coolant mostly flows into the upper tank portion and less flows into the lower tank portion. The opening 123 is disposed in the elevated portion 124 to be shifted toward the lower tank portion.

According to the first embodiment, the tank 120 has the opening 123 and the elevated portion 124 formed in the vicinity of the opening 123. The dimension Li of the tank 120 including the elevated portion 124 is larger than the dimension L of the tank 120 excluding the elevated portion 124. Therefore, a volume of the tank 120 and a sectional area of the tank 120 in the vicinity of the opening 123 are increased. As a result, when coolant enters the tank 120 through the opening 123 and changes a flow direction at the opening 123, pressure loss of coolant is decreased. Also, since the sectional area of the tank 120 in the vicinity of the opening 123 is increased, a sectional area of a coolant flow passage of the radiator 100 is restricted from largely decreasing in the tank 120. Therefore, pressure loss of coolant in the tank 120 is decreased. Thus, even if a size of the tank 120 is decreased to reduce a size of the radiator 100, pressure loss of coolant in the tank 120 is restricted from increasing.

The elevated portion 124 may be formed opposite to the opening 123, that is, at the right side in FIG. 3. Also in this case, the volume of the tank 120 and the sectional area of the tank 120 in the vicinity of the opening 123 are increased. However, as shown in FIG. 3, a width Lo of the radiator 100 including the pipe 130 in the air flow direction is the sum of the dimension L and a dimension of the pipe 130 in an axial direction thereof. Therefore, if the elevated portion 124 is formed opposite to the opening 123, the width Lo is increased by a difference between the dimension L and the dimension Li.

According to the first embodiment, the elevated portion 124 is formed on the same side of the tank 120 as the opening 123, that is, the opening 123 is formed in the elevated portion 124. Therefore, the width Lo is not increased by the elevated portion 124, while pressure loss of coolant in the tank 120 is decreased. When the dimension L is smaller than a diameter D of the opening 123 (i.e., an inner diameter of the pipe 130), pressure loss of coolant in the tank 120 is effectively decreased. In the present embodiment, the diameter D is approximately twice as large as the dimension L.

Further, in the first embodiment, as shown in FIG. 3, the opening 123 is positioned in the lower portion of the elevated portion 124 to be shifted toward the lower tank portion into which less coolant flows. As a result, the upper tank portion into which coolant mostly flows is enlarged by the elevated portion 124. Therefore, when coolant enters the tank 120 and changes the flow direction, pressure loss of coolant is effectively decreased.

Further, in the first embodiment, the inner diameter of the inserted portion of the pipe 130 inserted into the opening 123 is increased toward the inside of the tank 120. Therefore, coolant flows more smoothly at a connection portion between the pipe 130 and the tank 120, and pressure loss of coolant in the tank 120 is further decreased. Furthermore, in the first embodiment, the tank 120 also has the elevated portion in the vicinity of the opening through which coolant is discharged. As a result, a flow resistance of coolant in the radiator 100 is further reduced. Further, the first and second header tanks 121, 122 are formed using common parts, thereby reducing manufacturing cost.

Figure 5:
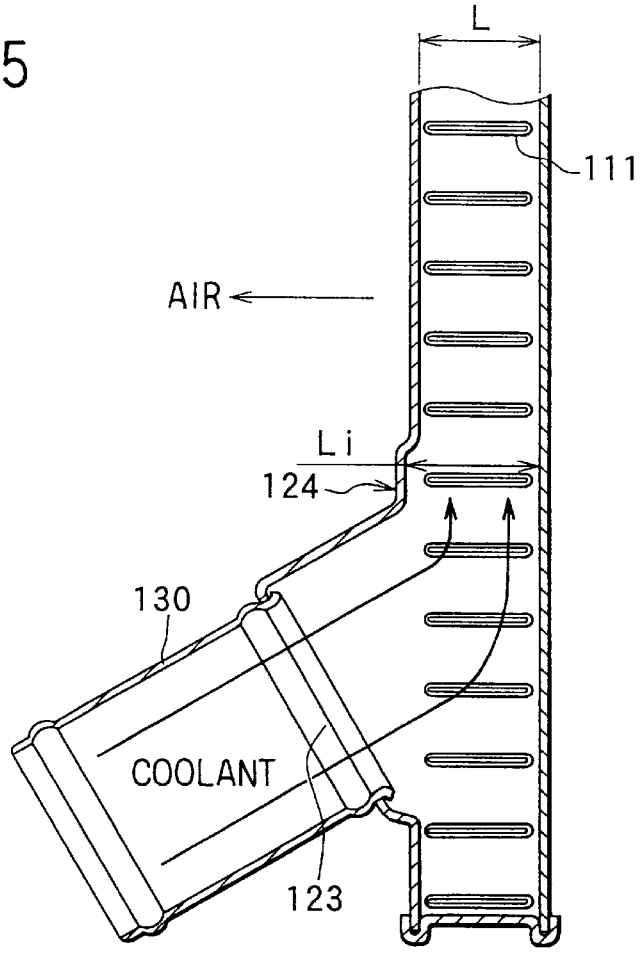
FIG. 5 is a sectional view showing a header tank and a pipe of a radiator according to a modification of the first embodiment.
Figure 6A:
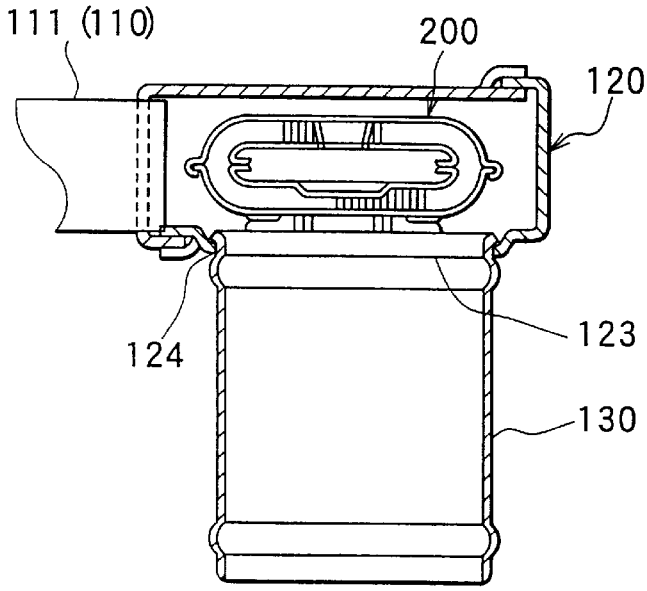
FIGS. 6A and 6B are sectional views each showing a header tank in which an oil cooler is disposed and a pipe of a radiator according to another modification of the first embodiment.
Figure 6B:
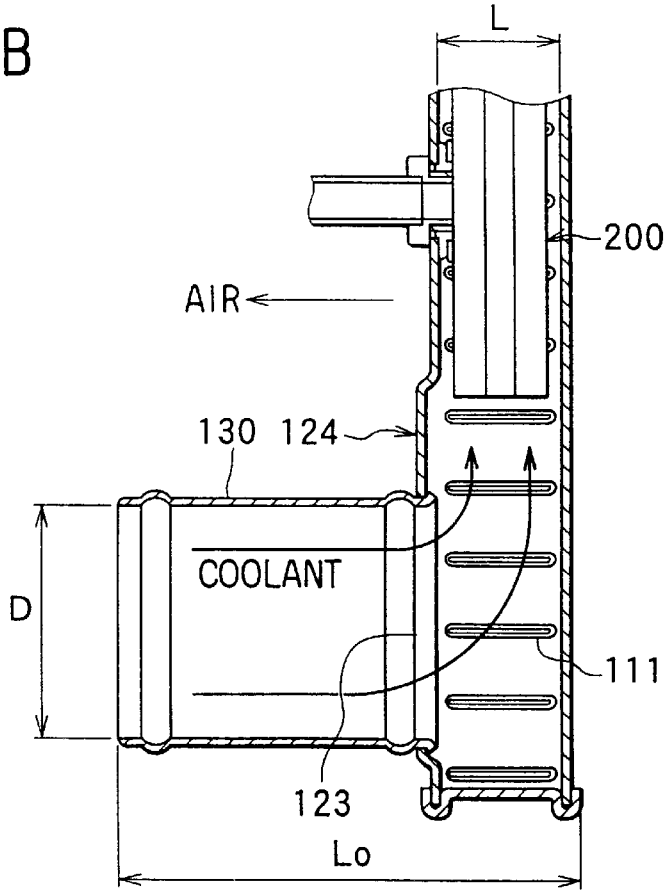

As shown in FIG. 5, the opening 123 may be opened in a direction at 45 degrees or the like to the longitudinal direction of the tank 120. Further, as shown in FIGS. 6A and 6B, an oil cooler 200 may be disposed in the tank 120. Hydraulic oil such as engine lubricant oil or automatic transmission fluid flowing in the oil cooler 200 exchanges heat with engine coolant flowing in the tank 120 so that hydraulic oil is cooled.

(Second Embodiment)

A second preferred embodiment of the present invention will be described with reference to FIGS. 7 and 8. In this embodiment, components which are substantially the same as those in the previous embodiment are assigned the same reference numerals, and the explanation thereof is omitted.

Figure 7:
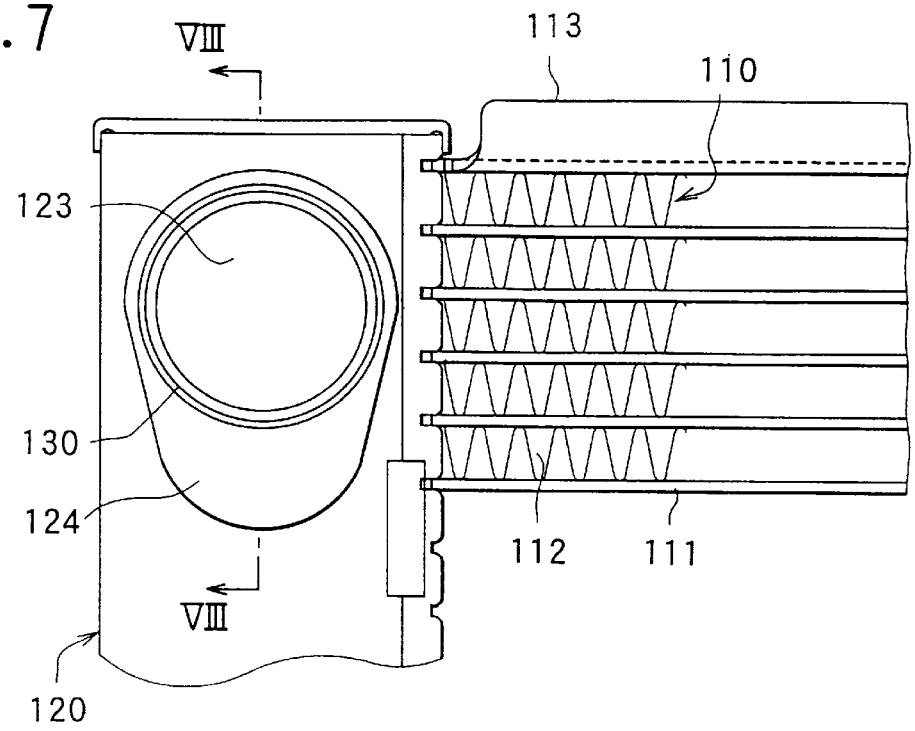
FIG. 7 is a partial front view showing a radiator according to a second preferred embodiment of the present invention.
Figure 8:
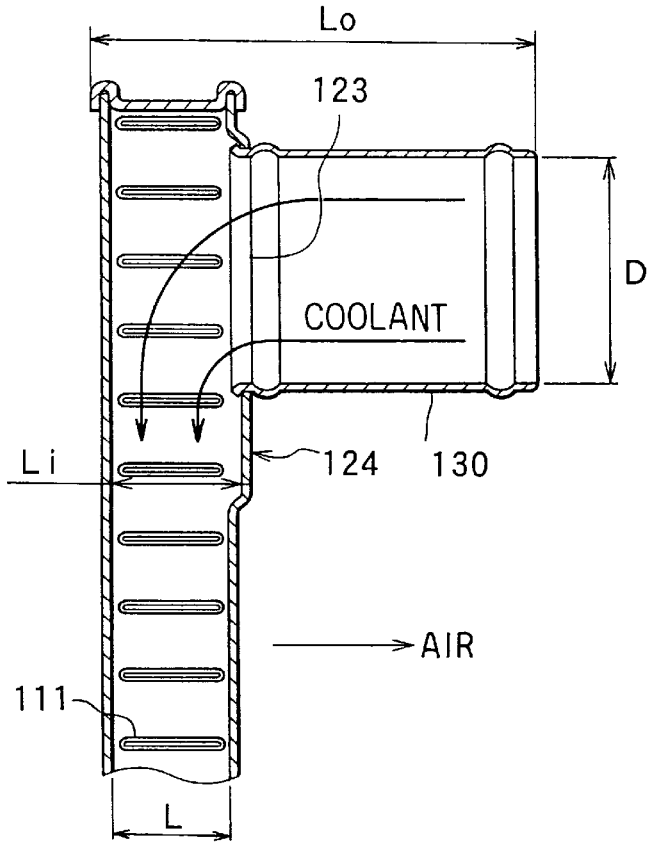
FIG. 8 is a sectional view taken along line VIII—VIII in FIG. 7.

In the second embodiment, as shown in FIGS. 7 and 8, the opening 123 is disposed at an upper longitudinal end of the tank 120 in a longitudinal direction thereof. Also in this case, the similar effect as with the first embodiment is obtained.

The present invention may be applied to other heat exchangers such as a condenser.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a plurality of tubes through which fluid flows;

a tank disposed at a flow-path end of each tube to extend in a direction perpendicular to a longitudinal direction of each tube and communicating with each tube, the tank including an opening open in a direction at a preset angle to a longitudinal direction of the tank and connectable to an external pipe, and an elevated portion elevated outwardly in the vicinity of the opening, wherein a dimension of the tank including the elevated portion in a direction perpendicular to the longitudinal direction of the tank is larger than a dimension of the tank excluding the elevated portion in the direction perpendicular to the longitudinal direction of the tank; and wherein the elevated portion is provided on the same surface of the tank as the opening portion.

2. The heat exchanger according to claim 1, wherein the opening is disposed in the elevated portion.

3. The heat exchanger according to claim 1, further comprising a pipe inserted into the opening and connected to the tank, wherein an inner diameter of an inserted portion of the pipe inserted into the opening is increased toward an inside of the tank.

4. The heat exchanger according to claim 3, wherein the pipe is formed into a cylindrical shape.

5. The heat exchanger according to claim 1, wherein:

the number of the tubes connected between the opening and a first end of the tank in the longitudinal direction of the tank is less than the number of the tubes connected between the opening and a second end of the tank in the longitudinal direction of the tank; and the opening is disposed in the elevated portion to be shifted from a center of the elevated portion in the longitudinal direction of the tank toward the first end of the tank.

6. The heat exchanger according to claim 1, wherein the tank is made of metal.

7. The heat exchanger according to claim 1, wherein the opening is open in a direction substantially perpendicular to the longitudinal direction of the tank.

8. The heat exchanger according to claim 1, wherein the opening is open in a direction at approximately 45 degrees to the longitudinal direction of the tank.

9. The heat exchanger according to claim 1, further comprising an oil cooler disposed in the tank, wherein an oil flowing in the oil cooler exchanges heat with the fluid flowing in the tank to be cooled.

10. The heat exchanger according to claim 1, wherein the fluid flows into the tank through the opening.

11. The heat exchanger according to claim 10, wherein the opening is disposed at a lower end portion of the tank in the longitudinal direction of the tank.

12. The heat exchanger according to claim 10, wherein the opening is disposed at an upper end portion of the tank in the longitudinal direction of the tank.

13. The heat exchanger according to claim 1, wherein the tank has a pipe protruding from the elevated portion and having the opening at a front end thereof, the opening being open in the direction that is non-perpendicular to the longitudinal direction of the tank so that the fluid introduced from the external pipe through the opening is turned at an outside angle to enter the tube when the external pipe is connected to the opening.

14. The heat exchanger according to claim 1, wherein the elevated portion has the opening at a front end thereof.

15. The heat exchanger according to claim 1, wherein a direction in which the elevated portion is elevated is approximately parallel to the direction in which the opening is open.

16. The heat exchanger according to claim 1, wherein the elevated portion is elevated in a direction that is approximately perpendicular to the longitudinal direction of each tube.

17. A heat exchanger comprising:

a plurality of tubes through which fluid flows;

a tank disposed at a flow-path end of each tube to extend in a direction perpendicular to a longitudinal direction of each tube and communicating with each tube, the tank including an opening open in a direction at a preset angle to a longitudinal direction of the tank and connectable to an external pipe, and an elevated portion elevated outwardly in the vicinity of the opening, wherein a dimension of the tank including the elevated portion in a direction perpendicular to the longitudinal direction of the tank is larger than a dimension of the tank excluding the elevated portion in the direction perpendicular to the longitudinal direction of the tank;

the opening is formed into a substantially circular shape; and the dimension of the tank excluding the elevated portion is smaller than a diameter of the opening.

18. The heat exchanger according to claim 17, wherein the diameter of the opening is approximately twice as large as the dimension of the tank excluding the elevated portion.

19. A heat exchanger comprising:

a plurality of tubes through which fluid flows;

a first tank disposed at a first flow-path end of each tube to extend in a direction perpendicular to a longitudinal direction of each tube and communicating with each tube, the first tank including a first opening disposed at an end of the first tank in a longitudinal direction thereof, and a first elevated portion elevated outwardly in the vicinity of the first opening, the first elevated portion being provided on the same surface of the first tank as the first opening;

a second tank disposed at a second flow-path end of each tube to extend in the direction perpendicular to the longitudinal direction of each tube and communicating with each tube, the second tank including a second opening disposed at an end of the second tank in a longitudinal direction thereof, and a second elevated portion elevated outwardly in the vicinity of the second opening, the second elevated portion being provided on the same surface of the second tank as the second opening, wherein:

the fluid flows into the first opening and is discharged from the second opening;

the first opening and the second opening are disposed diagonally;

a dimension of the first tank including the first elevated portion in a direction perpendicular to the longitudinal direction of the first tank is larger than a dimension of the first tank excluding the first elevated portion in the direction perpendicular to the longitudinal direction of the first tank; and a dimension of the second tank including the second elevated portion in a direction perpendicular to the longitudinal direction of the second tank is larger than a dimension of the second tank excluding the second elevated portion in the direction perpendicular to the longitudinal direction of the second tank.

* * * * *